United States Patent [19]

Brockelsby

[11] 3,948,488

[45] Apr. 6, 1976

[54] MOUNTING MEANS FOR POWER ANCHOR WINCH

[75] Inventor: Norman D. Brockelsby, Grand Island, Nebr.

[73] Assignee: Dutton-Lainson Company, Hastings, Nebr.

[22] Filed: Sept. 12, 1974

[21] Appl. No.: 505,316

[52] U.S. Cl. ..... 254/186 R; 114/235 R

[51] Int. Cl.[2] ..... B66D 1/00

[58] Field of Search ..... 254/195, 186 R, 150 R, 254/163, 175.5, 175.7, 187 C, 187 D, 171; 114/210, 235 WS, 235 R; 248/216, 276, 310, 122

[56] References Cited

UNITED STATES PATENTS

| | | | |
|---|---|---|---|
| 1,747,034 | 2/1930 | Sonntag | 254/187 C |
| 2,489,679 | 11/1949 | Sherry | 254/195 |
| 3,049,340 | 8/1962 | Magnuson | 254/186 |
| 3,147,935 | 9/1964 | Wilson | 114/235 WS |
| 3,288,438 | 11/1966 | Baas | 254/150 R |
| 3,536,298 | 10/1970 | Deslierres | 254/175.7 |
| 3,628,505 | 12/1971 | Myers | 254/187 C |
| 3,698,690 | 10/1972 | Beaver | 254/186 |
| 3,813,055 | 5/1974 | Picknell | 114/235 WS |
| 3,834,670 | 9/1974 | Pityo | 250/150 R |

*Primary Examiner*—Robert J. Spar
*Assistant Examiner*—Kenneth Noland
*Attorney, Agent, or Firm*—Allegretti, Newitt, Witcoff & McAndrews

[57] ABSTRACT

The mounting means of this invention is specifically adapted for mounting a power winch, adapted to raise and lower a boat anchor, at any one of a large variety of locations on the boat. The design of the mounting means permits the anchor winch to be mounted in almost any desired location on the boat by means of an L-shaped mounting bracket which cooperates with a reel mounting bracket and projecting means connecting the reel mounting bracket to the L-shaped mounting bracket.

5 Claims, 6 Drawing Figures

MOUNTING MEANS FOR POWER ANCHOR WINCH

BACKGROUND OF THE INVENTION

The present invention is generally related to means for mounting a power winch specifically adapted for installation on a boat for use in raising and lowering boat anchors.

The power winch disclosed in this application and with which the mounting means are adapted to cooperate is generally of the type known prior to applicant's invention. For example, in U.S. Pat. No. 3,313,525, issued Apr. 11, 1967, to A. G. Vanderbeck, there is shown a winch motor operable through a 90° gear box for driving a winch construction. However, the mounting means of the present invention is not shown or suggested in this or any other patent or reference of which applicant is aware. Moreover, the particular construction of the winch has significance in that the mounting means are uniquely adapted to facilitate any one of a number of desired mounting locations for the power winch on a boat.

SUMMARY OF THE INVENTION

The present invention is an improvement in a power winch specifically adapted for use on a boat for the purpose of raising and lowering a boat anchor. The winch, which does not form a part of this invention, includes a reel and a reel drive shaft for rotating the reel, a motor having a motor drive shaft, and means for drivingly connecting the motor drive shaft to the reel drive shaft so that when the motor is energized, the reel may be rotated.

The improvement of this invention is mounting means for the power winch which includes, in combination, a generally L-shaped mounting bracket having a first plate and a second plate with the first and second plates forming the L-shaped mounting bracket. The motor is mounted on the inner surface of the first plate. A reel bracket is rotatably connected to the reel and means projecting from the outer surface of the first plate are provided for mounting the reel bracket and reel to the outer surface of the first plate and remote therefrom.

Means for connecting the projecting means to the reel bracket, and means on the second plate for connecting said second plate directly to said boat are also provided so that the power winch may be mounted on the boat in any one of a number of desired locations and orientations in which either the second plate is mounted to the boat at the desired mounting location or in which the boat shell is sandwiched between the first plate of the L-shaped bracket and the reel bracket.

It is a principal object of the present invention to provide a new and improved means for mounting a power winch for operating an anchor for a boat.

Another object of the present invention is to provide mounting means for a power winch which will be simple and economic to construct and which may be readily attached to a boat.

It is also an object of the present invention to provide such a mounting means which will permit the winch to be mounted in any one of a numerous variety of positions on a boat.

A still further object of the present invention is to provide a mounting means for a boat anchor winch which will permit the winch to be mounted in a variety of ways so that it may be rotated about a vertical or a horizontal axis, depending upon the particular mounting selected.

These and other objects, advantages and features of the present invention are more fully discussed in the detailed description of the preferred embodiment which follows.

BRIEF DESCRIPTION OF THE DRAWING

In the attached drawing, there is shown a presently preferred embodiment of the present invention connected to a boat in two different ways. In these drawings, like numerals refer to like elements and.

DETAILED DESCRIPTION OF THE PREFERRED EMBODIMENT

Figure 1:
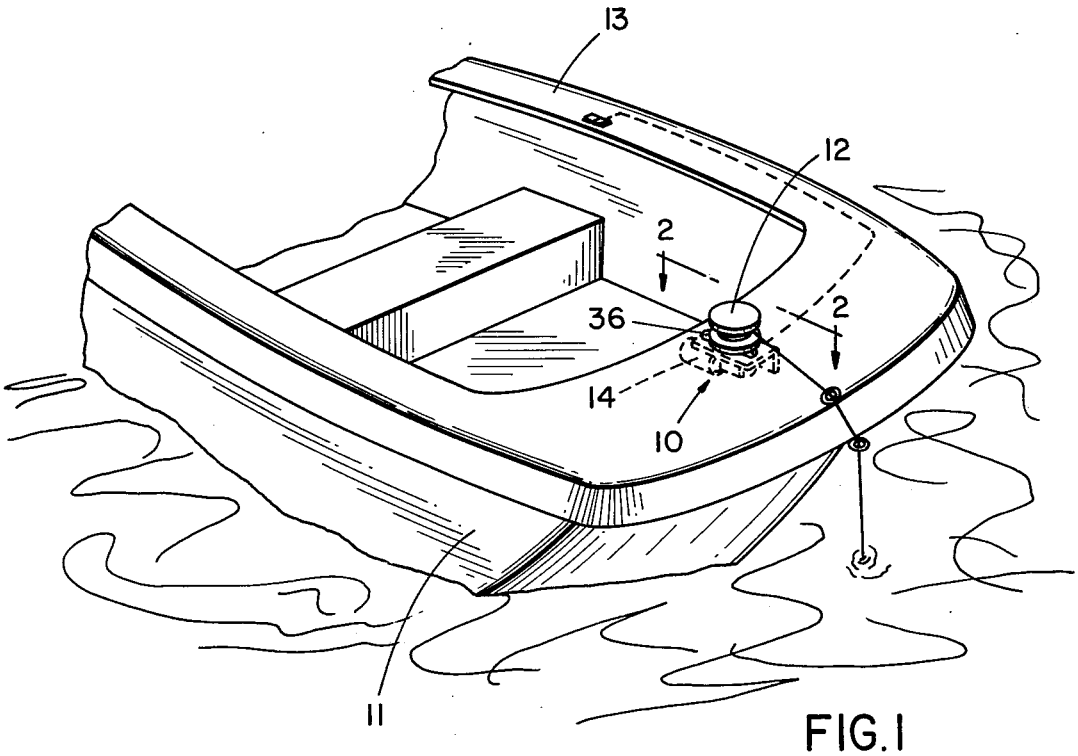
FIG. 1 is a side perspective view of a boat with the winch mounted on the bow deck with the reel of the winch above the deck.
Figure 2:
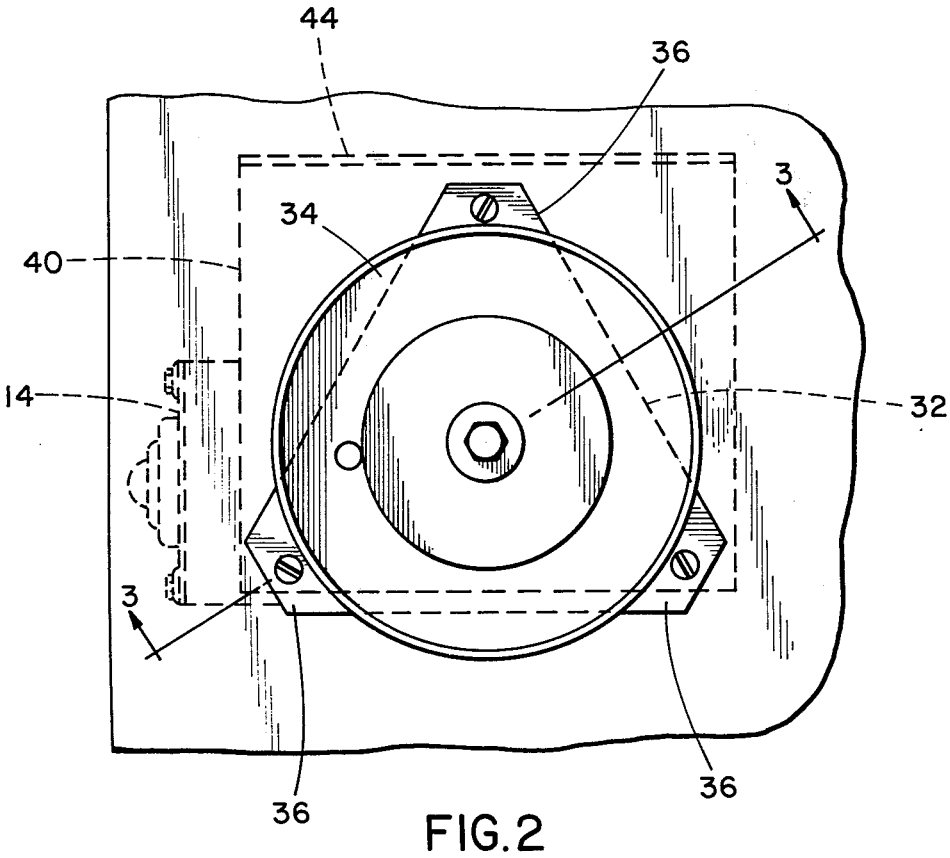
FIG. 2 is a top cross sectional view of the winch of FIG. 1 taken substantially along the lines 2—2.
Figure 3:
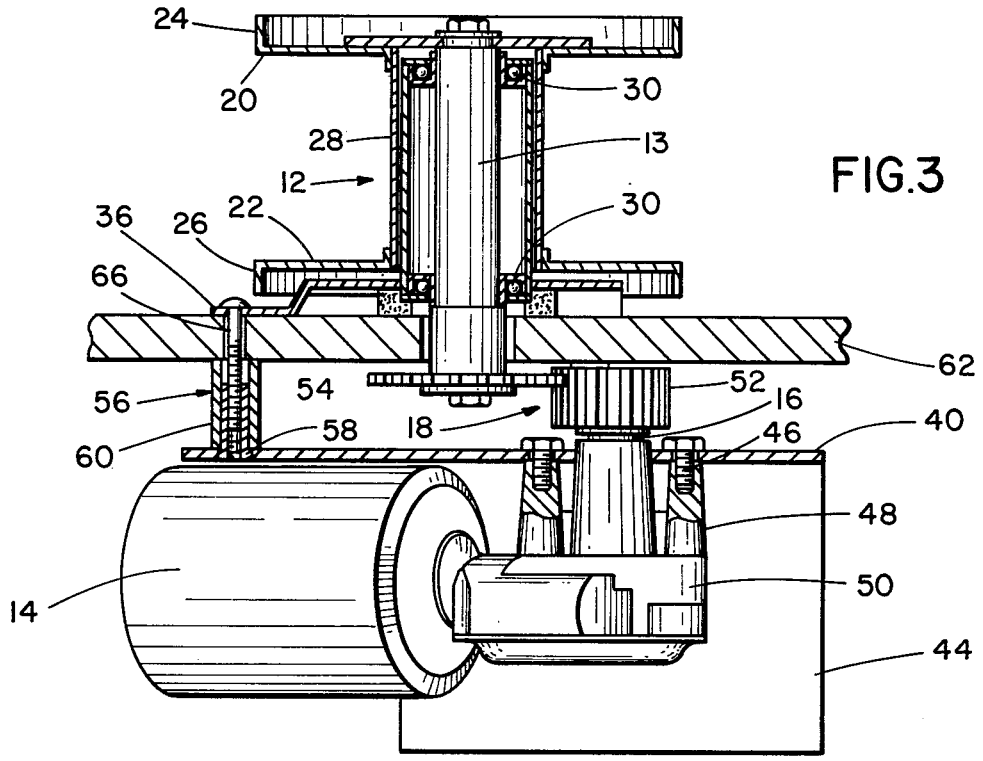
FIG. 3 is a side cross sectional view of the winch of FIG. 2 taken substantially along the lines 3—3.
Figure 4:
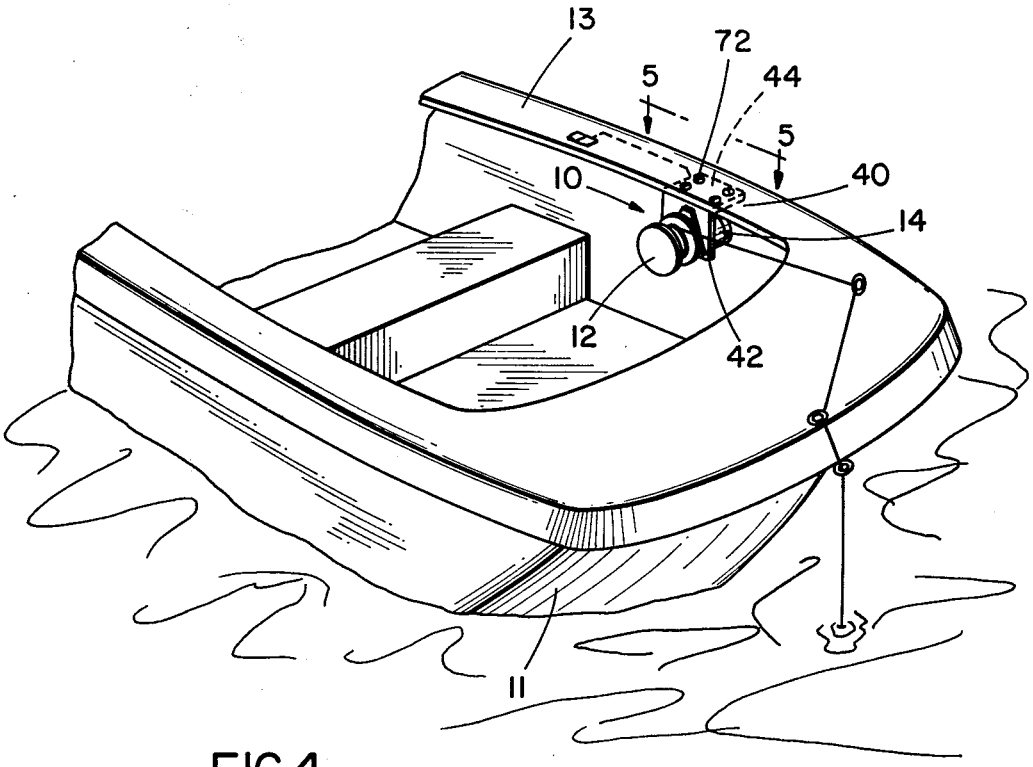
FIG. 4 is a side perspective view of a boat with the winch mounted on a side panel of the boat.
Figure 5:
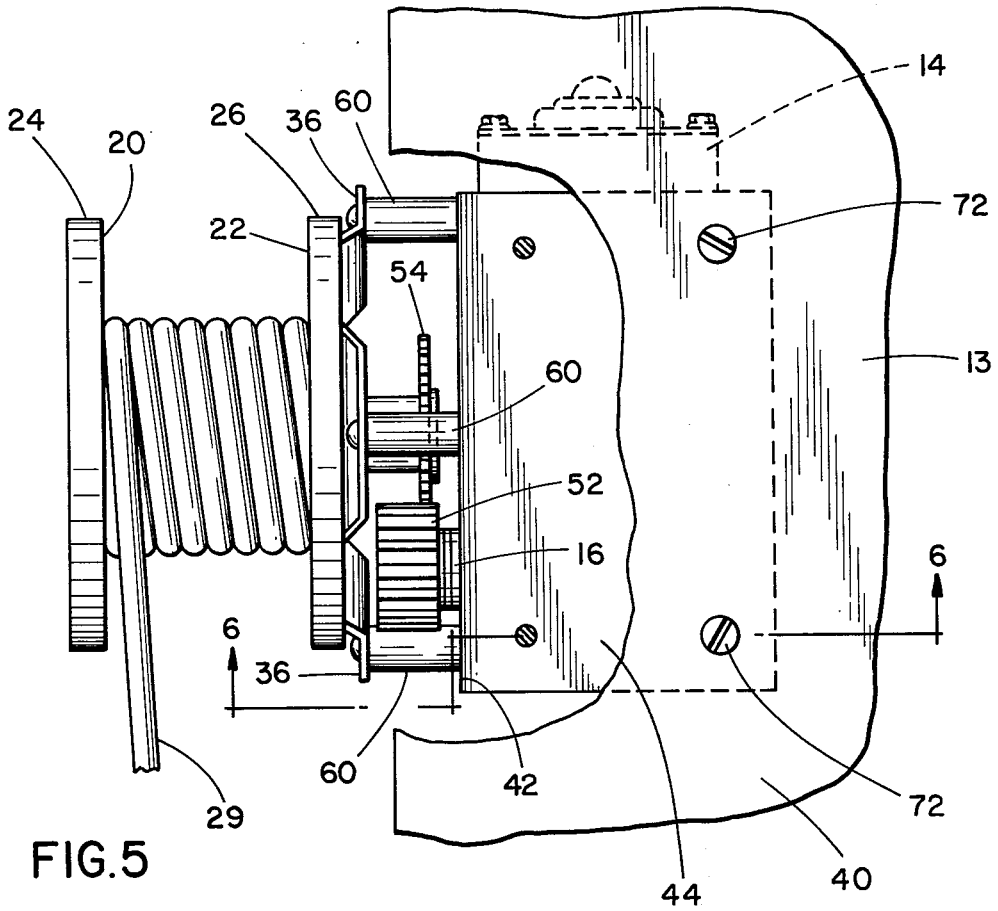
FIG. 5 is a top cross sectional view of the winch of FIG. 4 taken substantially along the lines 5—5.
Figure 6:
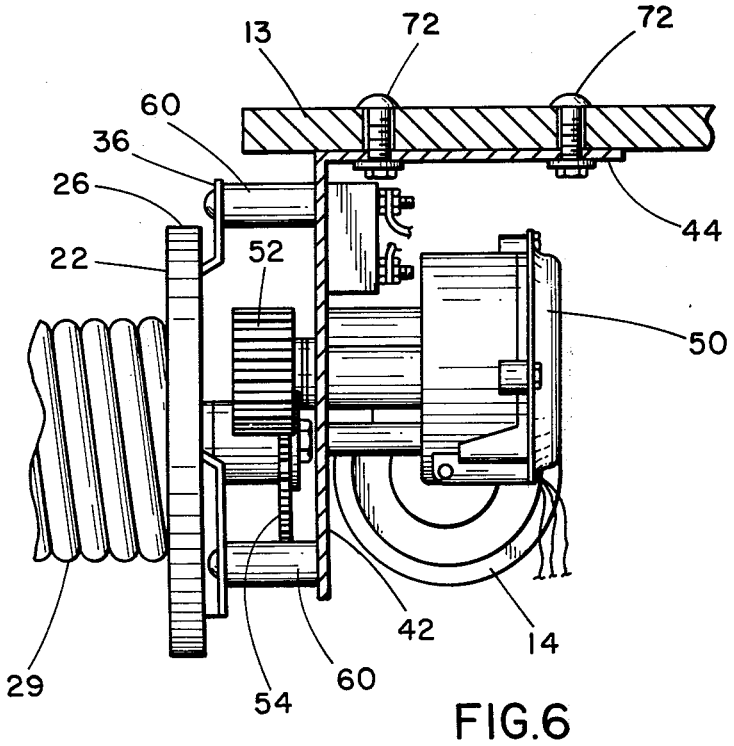
FIG. 6 is a partial cross sectional view of the winch of FIG. 5 taken substantially along the lines 6—6.

In the drawings two possible connections of the winch and mounting means of this invention are shown. In FIGS. 1, 2 and 3, a winch 10 is shown connected to the bow deck of a boat 11 with the reel 12 of the winch 10 above the deck. In FIGS. 4, 5 and 6, the winch 10 is connected to a side panel 13 of the boat 11.

Referring now to FIGS. 1, 2 and 3, the winch 10 is specifically adapted to raise and lower a boat anchor (not shown). The winch 10 includes a reel 12 and a reel drive shaft 13. A motor 14 is provided for operating the reel 12 through a motor drive shaft 16. Means 18 are provided for drivingly connecting the motor drive shaft 16 to the reel drive shaft 13 so that when the motor 14 is operated, the reel 12 may be rotated.

The reel 12 consists principally of a pair of circular rims 20 and 22 having annular flanges 24 and 26 connected to the outer circumference of the rims 22 and 24 and perpendicular thereto. A cylinder 28 for receiving an anchor cable 29 is sandwiched between the rims 20 and 22 connected thereto.

The cylinder 28 and rims 20 and 22 of the reel 12 and drive shaft 13 are rotatably connected by means of bearing assemblies 30 to a reel mounting bracket 32. The reel mounting bracket 32 is a single sheet of sturdy metal construction in the preferred embodiment and includes an inner plate section 34 substantially parallel with but slightly removed from the rim 22 of the reel 12. The reel mounting bracket 32 also includes three flange sections 36 integral with and parallel to the inner plate section 34. These flange sections 36 project outwardly from the axis of rotation of the reel 12 and are positioned axially outward from the outer flange member 26 of the rim 22 so that the reel 12 may be freely rotated with the flange sections 36 abutting against a desired mounting surface.

An L-shaped mounting bracket 40 is also provided and includes a first plate 42 and a second plate 44 integral with and perpendicular to the first plate 42. In a preferred embodiment the L-shaped mounting bracket is formed of a single sheet of sturdy metal material and is deformed to form the L-shape.

The motor 14 is mounted to the inner surface (i.e., within the 90° angle of the L-shaped bracked 40) of first plate 42 of the L-shaped mounting bracket 40 by means of three bolts 46. The bolts 46 are threadably connected through the first plate 42 to three corresponding threaded female connector members 48 rigidly connected to an extension 50 of the motor 14. The motor drive shaft 16 projects through the first plate 42.

The means for drivingly connecting the motor drive shaft 16 to the reel drive shaft 13 functions as a gear reduction drive and includes a first gear 52 connected for rotation to the motor drive shaft 16, and a second gear 54 connected for rotation to the reel drive shaft 13. First gear 52 is positioned to operatively engage with the second gear 54 when the reel bracket 32 is connected to the L-shaped bracket 40. The gear 52 is axially wider than gear 54 so as to permit engagement at any one of a variety of axial locations.

Projecting means 56 provide means for connecting the reel mounting bracket 32 to the L-shaped mounting bracket 40 and thereby for connecting the reel 12 and the motor 14. The projecting means 56 include three annular cylindrical shaped neck members 58 (only one of which is shown in FIG. 3) connected to and extending perpendicularly outward from the outer surface of the first plate 42. Collar spacer members 60 adapted to fit snugly over and against neck members 58 are also provided. The spacers 58 are of such an axial length as to space apart the first plate 42 of the L-shaped bracket 40 from a deck or other portion of a boat shell 62 by a desired predetermined distance.

Screw means 66 are also provided for connecting the neck members 58 to the reel bracket 32. The screws 66 are inserted through holes in the flange sections 36 of the reel bracket 32 and are threadably engaged with the inner surface of the neck members 58.

In the mounting shown in FIGS. 1–3, only the reel 12 and reel bracket 32 project above the bow deck 62 of the boat 11. The remainder of the apparatus including the L-shaped bracket 40, gears 52 and 54, projecting means 56 and motor 14 are all hidden from view below the bow deck of the boat 11. The axial width of gear 52 permits the mounting means to adapt to variable thicknesses of the shell of boat 11. In this configuration, the reel 12 rotates about a vertical axis.

Referring now to FIGS. 4, 5 and 6, a second alternative connection is shown in which the second plate 44 of the mounting bracket 40 is directly connected to the underside of the horizontal side panel 13 of the boat 11. This connection may be made by means of four screws 72 connected from the top surface of side panel 13 through four holes on plate 44. With this configuration, the reel 12 rotates about a horizontal axis.

Referring now to FIGS. 5 and 6, it can be seen that the second gear 54 is advanced in an engagement position further along the axis of rotation of the first gear 52 (see FIG. 3 for comparison). In this connection, the distance between the flange sections 36 of the reel mounting bracket 32 and the first plate 42 of the L-shaped mounting bracket 40 is defined by the axial length of spacer members 60. In the configuration of FIGS. 1–3, this distance includes the axial length of the spacer members 60 plus the thickness of the boat shell 62.

A variety of other connections of the winch 10 to the boat 11 may also be made which are not shown in the drawings. For example, the entire assembly may be connected below the bow deck of the boat 11 with the second plate 44 directly connected to the under surface of the deck. Also, the assembly could be connected at the stern of the boat 11 to a horizontal side panel with the reel bracket 32 and first panel 42 sandwiching the stern side panel. As can be seen, the mounting means of this invention permits the winch 10 to be mounted in any one of a large variety of positions on the boat 11. Also, the mounting means of this invention permits the reel 12 of the winch 10 to be rotated about various axes.

While in the foregoing there has been described a presently preferred embodiment of this invention, it should be understood that this embodiment is merely illustrative of the invention and that other embodiments may be made without departing from the true spirit and scope of the invention.

What is claimed is:

1. In a power winch for raising and lowering a boat anchor, said winch including a reel with a rim drivingly connected to a motor for rotating said reel, an improved means for mounting said winch on a boat comprising, in combination:

a generally L-shaped mounting bracket, having a first plate and a second plate forming said L-shaped mounting bracket, said first plate having an inner surface and an outer surface, said motor being mounted on the inner surface of said first plate, means projecting from the outer surface of said first plate a reel bracket rotatably connected to said reel, said reel bracket including a plate connected adjacent to and within the rim of said reel and substantially perpendicular to the axis of rotation of the reel and at least three flange plates substantially parallel with said first plate and projecting outwardly of said rim, said flange plates positioned axially outward from said rim whereby said reel may be freely rotated as the flange plates rest against a mounting location, means for connecting said projecting means to said reel bracket, and means on said second plate for connecting said second plate to a desired mounting surface whereby said power winch may be mounted on the boat in any one of a number of desired locations or orientations in which either the said second plate is mounted against the desired mounting surface or in which the motor and L-shaped bracket are on one side of the desired mounting location and the reel and reel bracket are on the other side of said mounting location.

2. The improvement as set forth in claim 1 in which the projecting means include at least three neck members connectable to said reel bracket by screws.

3. The improvement as set forth in claim 1 wherein said means for drivingly connecting said motor and reel includes a drive shaft for said motor connected to a reel drive shaft by means including a gear reduction drive having a first gear connected to said motor drive shaft and a second gear connected to said reel drive shaft, said gears positioned to operatively engage with one another when said reel bracket is connected to said L-shaped bracket, said projection means being adapted to space the reel bracket from the L-shaped mounting bracket by a distance sufficient to permit the thickness of the desired mounting location to be sandwiched between the reel bracket and the outermost portion of the first gear.

4. The improvement as set forth in claim 1 including first and second gears for drivingly connecting said motor to said reel in which one of said gears has an axial width sufficient to permit the other gear to engage with said one gear at a variety of axial locations.

5. In a power winch for raising and lowering a boat anchor, said winch including a reel drivingly connected to a motor for rotating said reel, an improved means for mounting said winch on a boat comprising, in combination:

a generally L-shaped mounting bracket, said bracket having a first plate and a second plate defining said L shape, said first plate having an inner surface and an outer surface, said motor being mounted on the inner surface of said first plate, means projecting from the outer surface of said first plate comprising spacer collar members, a reel bracket rotatably connected to said reel, means for connecting said spacer collar members to said reel bracket to maintain said reel bracket fixed a spaced distance relative to said first plate, means on said second plate for connecting said second plate to a desired mounting surface, and first and second engaged gears intermediate the first plate and reel bracket for drivingly connecting said motor with said reel, one of said gears including teeth of an axial width greater than the other and sufficient to cooperate with the teeth of the other gear at a variety of relative axial positions of said engaged gear, whereby said power winch may be mounted on the boat in any one of a number of desired locations or orientations in which either the said second plate is mounted against the desired mounting surface or in which the motor and L-shaped bracket are on one side of the desired mounting location and the reel and reel bracket are on the other side of the mounting location, the distance of separation being accommodated by said gears to provide driving connection between said reel and said motor.

* * * * *